US012350725B2

(12) United States Patent
Singh et al.

(10) Patent No.: US 12,350,725 B2
(45) Date of Patent: Jul. 8, 2025

(54) COMPONENTS PRODUCED FROM METALLIC BLANKS AND METHODS FOR PRODUCING THE SAME

(71) Applicant: GM GLOBAL TECHNOLOGY OPERATIONS LLC, Detroit, MI (US)

(72) Inventors: Jatinder P Singh, Troy, MI (US); Christopher Ian Roman, Ortonville, MI (US); Adam R. Groseclose, Sterling Heights, MI (US); Kevin Anthony Beam, Rocherster Hills, MI (US); Thomas Joseph Mitcheltree, III, Roseville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/339,855

(22) Filed: Jun. 22, 2023

(65) Prior Publication Data

US 2024/0424545 A1 Dec. 26, 2024

(51) Int. Cl.
*B21D 22/02* (2006.01)

(52) U.S. Cl.
CPC ..... *B21D 22/02* (2013.01)

(58) Field of Classification Search
CPC ..... B21D 22/02; B21D 22/20; B21D 22/21
See application file for complete search history.

(56) References Cited

U.S. PATENT DOCUMENTS 6,578,430 B1 * 6/2003 Duerr ..... G01N 3/062 73/787
6,983,660 B2 * 1/2006 Kwon ..... G01N 3/32 73/806
10,467,361 B2 * 11/2019 Shirakami ..... B21D 22/00
11,590,591 B2 * 2/2023 Fujii ..... G01N 3/24
2015/0082855 A1 * 3/2015 Fujii ..... G06F 30/17 72/379.2
2023/0311192 A1 * 10/2023 Hill ..... B21D 22/201
2024/0246134 A1 * 7/2024 Hamada ..... B23K 26/322

FOREIGN PATENT DOCUMENTS

DE 10233008 A1 2/2004
DE 102008017728 A1 10/2009
DE 102022117942 A1 1/2023

OTHER PUBLICATIONS

CN 116140444A, Ma et al. May 2023.*
WO 2023/032953A1, Kubo Mar. 2023.*
WO 2022/176276A1, Nakagawa et al. Aug. 2022.*
CN 113843326A, Li et al. Dec. 2021.*
DE 2014001872A1, Tekkaya et al. Aug. 2015.*
JP 2006-198672A, Ueda Aug. 2006.*

* cited by examiner

*Primary Examiner* — Edward T Tolan
(74) *Attorney, Agent, or Firm* — Lorenz & Kopf LLP

(57) ABSTRACT

Components, methods for producing the components from metallic blanks, and vehicles comprising the components are provided. The components include a body having protrusions and recesses formed by a process including forming the component from a metallic blank by a drawing or stamping process. The metallic blank has at least one notch along a perimeter thereof that is configured to reduce elastic strain retained in the component formed therefrom. The at least one notch provides for relaxation of elastic strain within the component during the drawing or stamping process and thereby reduces springback distortion of the component.

8 Claims, 10 Drawing Sheets

COMPONENTS PRODUCED FROM METALLIC BLANKS AND METHODS FOR PRODUCING THE SAME

INTRODUCTION

The technical field generally relates to methods of manufacturing components from metallic blanks, and more particularly relates to methods for producing metallic blanks, and for producing components therefrom, in a manner such that distortion of the component is reduced, such as distortion resulting from a springback or oil canning phenomenon.

Various components are commonly manufactured from metallic blanks, that is, sheets of metal, using processes such as drawing and stamping. Stamping is a process that uses a press and a die to shape the blank. The die may include a male punch and a female die cavity. The blank is placed between the punch and die, and when the press applies pressure, the blank is formed into a desired shape. Stamping is commonly used to produce components with simple or complex geometries, such as brackets, washers, automotive body panels, and appliance parts. Drawing is a process wherein the blank is clamped over a die and a punch is used to push the blank into the die cavity, causing it to stretch and take on the shape of the die. Drawing is commonly used in the production of items like cans, tubes, containers, and automotive parts like exhaust pipes, body sides, floor pans, dash panels, etc.

Producing components from metallic blanks may provide various benefits, such as in terms of design flexibility, cost-effectiveness, time efficiency, precision, and material properties. However, certain components can be challenging to produce from metallic blanks due to distortion phenomenon such as springback or oil canning wherein compressed strains in the component cause unstable distortion such as twisting of the component during the manufacturing process, such as upon removal from a die or a press.

Accordingly, it is desirable to provide methods for producing components from metallic blanks that reduce the likelihood of distortion of the component. Furthermore, other desirable features and characteristics of the present invention will become apparent from the subsequent detailed description and the appended claims, taken in conjunction with the accompanying drawings and the foregoing technical field and background.

SUMMARY

In one implementation, a method is provided that includes determining a location of an area of concentrated total strain, including both plastic strain and elastic strain, based on a structure of a component to be produced, and forming at least one notch along a perimeter of a metallic blank that is configured to be used to produce the component based at least in part on the location of the area of concentrated total strain, wherein the at least one notch is configured to reduce elastic strain retained in the component during production thereof.

In various examples, the method includes producing the component from the metallic blank by a drawing or stamping process, wherein the at least one notch provides for relaxation of elastic strain within the component during the drawing or stamping process and thereby reduces distortion of the component.

In various examples, the at least one notch is formed in the metallic blank prior to producing the component therefrom.

In various examples, the method includes generating a strain map for the component, wherein determining the first location of the area of concentrated total strain is performed, at least in part, using the strain map, and determining a size, shape, and the second location of the at least one notch, at least in part, using computational modeling.

In various examples, the method includes forming the at least one notch at a corner of the metallic blank.

In various examples, the method includes forming the at least one notch along a side edge of the metallic blank between a pair of corners thereof.

In various examples, the method includes forming the at least one notch to define a gap in a sidewall of the component.

In various examples, the metallic blank of the method is formed of a mild, medium, high strength, or third generation (3rd Gen or Gen3) advanced high-strength (AHSS) steels, or an aluminum alloy.

In various examples, the component of the method is configured to be installed as a structural component of a vehicle.

In another implementation, a component is provided that includes a body having protrusions and recesses formed by a process including forming the component from a metallic blank by a drawing or stamping process. The metallic blank has at least one notch along a perimeter thereof that is configured to reduce elastic strain retained in the component formed therefrom. The at least one notch provides for relaxation of elastic strain within the component during the drawing or stamping process and thereby reduces springback distortion of the component.

In various examples, the at least one notch of the component is located at a corner of the metallic blank.

In various examples, the at least one notch of the component is located along a side edge of the metallic blank between a pair of corners thereof.

In various examples, wherein the at least one notch of the component is located is a waste (offal) material region exterior to the perimeter of the component, and the process includes performing a finishing process to remove the waste material region.

In various examples, the at least one notch of the component defines a gap in a sidewall of the component.

In various examples, the metallic blank of the component is formed of a mild, medium, high strength, or third generation (3rd Gen or Gen3) advanced high-strength (AHSS) steels, or an aluminum alloy.

In various examples, the component is configured to be installed as a structural component of a vehicle.

In another implementation, a vehicle is provided that includes a structural component including a body having protrusions and recesses formed by a process comprising forming the component from a metallic blank by a drawing or stamping process. The metallic blank is formed of a mild, medium, high strength, or third generation (3rd Gen or Gen3) advanced high-strength (AHSS) steels, or an aluminum alloy and has at least one notch along a perimeter thereof that is configured to reduce elastic strain retained the component formed therefrom. The at least one notch provides for relaxation of elastic strain within the component during the drawing or stamping process and thereby reduces springback distortion of the component.

In various examples, the at least one notch of the metallic blank of the vehicle is located at a corner of the metallic blank or along a side edge of the metallic blank between a pair of corners thereof.

In various examples, the at least one notch of the metallic blank of the vehicle is located is a waste material region exterior to the perimeter of the component, the process comprising performing a finishing process to remove the waste material region.

In various examples, the at least one notch of the metallic blank of the vehicle defines a gap in a sidewall of the component.

BRIEF DESCRIPTION OF THE DRAWINGS

The exemplary embodiments will hereinafter be described in conjunction with the following drawing figures, wherein like numerals denote like elements, and wherein:

FIGS. 5 and 6 illustrate distortion of the components as predicted by modeling.

FIGS. 7 and 8 illustrate distortion of the component as measured by scanning techniques.

FIGS. 9 and 10 illustrate in-plane stress of the components as predicted by modeling.

DETAILED DESCRIPTION

The following detailed description is merely exemplary in nature and is not intended to limit the application and uses. Furthermore, there is no intention to be bound by any expressed or implied theory presented in the preceding technical field, background, brief summary or the following detailed description.

Figure 1:
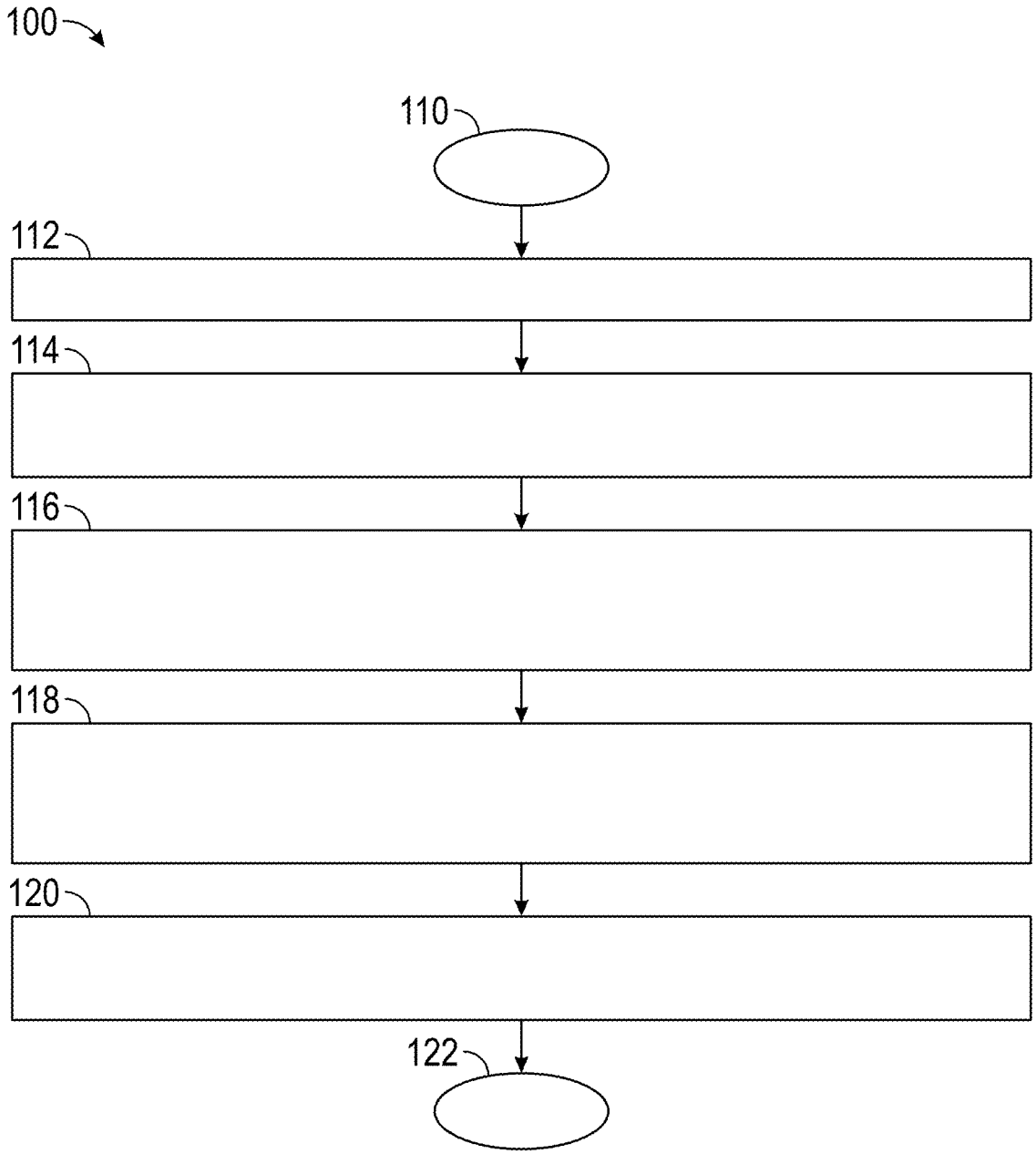
FIG. 1 is flowchart representing a method for producing a component from a metallic blank in accordance with various implementations.

Referring initially to FIG. 1, a flowchart provides a nonlimiting method 100 for producing a component, in accordance with exemplary implementations. As can be appreciated in light of the disclosure, the order of operation within the method 100 is not limited to the sequential execution as illustrated in FIG. 1, but may be performed in one or more varying orders as applicable and in accordance with the present disclosure.

In general, the method 100 includes producing the blank as an intermediate product and subsequently producing a component from the blank by a manufacturing process such as, but not limited to, a drawing, forming, stamping, or machining process. Certain components can be challenging to produce from metallic blanks due to distortion mechanisms such as springback and oil canning. For example, formation of various features of a component during the manufacturing process may results in one or more areas of localized and/or concentrated total strain (including both plastic and elastic stain). Within these area(s) of concentrated total strain, plastic strain may retrain, "lock," or "trap" elastic strain, that is, effectively limit or reduce the likelihood that the elastic strain may relax upon release of forces used to produce the features of the component (e.g., removal from a die or press). This trapped elastic strain may cause unstable physical distortion across the component including, for example, twisting of the component relative to a baseline geometric plane (e.g., an initial plane of the blank prior to producing the component therefrom). As used herein, an area of total strain is considered to be concentrated if the total strain is sufficient, that is, exceeds a minimum threshold, where upon release of the forces used to produce the features of the component (e.g., removal from a die or press), the total strain causes uncontrolled distortion of the component. The minimum threshold of the total strain to be considered to be concentrated will vary depending on, for example, a gauge or thickness of the component and a strength of the component (e.g., resistance to distortion resulting from strain).

The method 100 may reduce springback and/or uncontrolled distortion (oil canning) during the manufacturing process by producing the blank with one or more notches that are each configured to distribute, disperse, or otherwise break up a corresponding area of concentrated total strain that is predicted to result from subsequent manufacturing steps intended to be performed on the blank to produce a specific component, such as steps of a drawing or stamping process. Pre-notching the blank with notches having specific, predetermined locations, shapes, and sizes enable localized reduction of retained compressive stress in the component, which cause twist/springback distortions. More specifically, breaking up areas of concentrated total strain allow of areas of elastic strain to relax such that the shape of the component is not changed or has limited change due to the retained elastic strain. That is, by relieving the compression stresses, the component has a more stable behavior during the manufacturing process and thereby may reduce challenges associated with part handling and processing in subsequent tooling operations.

In one example, the method 100 may start at 110. At 112, the method 100 may include determining a structure of a component to be produced from a metallic blank prior to formation of the component or the metallic blank. The component may have various intended purposes and/or applications, and may include various structures and features such as, but not limited to, a plurality of protrusions, recesses, and/or openings/holes having various shapes and sizes. Methods for designing such components are well known in the art and therefore will not be described in detail herein. In various examples, the component may be designed, predetermined, and/or produced in a computer-aided design (a.k.a., computer-aided drafting, computer assisted drafting, CAD, etc.) software program as a two-dimensional (2D) drawing, a three-dimensional (3D) model, or both.

At 114, the method 100 may include determining areas of localized or concentrated total strain that are predicted to be produced during the manufacturing process based on the structure of the component. Notably, the specific locations, sizes or areas, and concentration of total strain produced in the component will be dependent, for example, on the shapes, sizes, and locations of the features of the structure of the component, materials from which the component is formed, and the parameters of the manufacturing process. The areas of concentrated total strain may be determined in various manners. In various examples, the areas of concentration may be predicted using a computational modeling software program configured for such application, and/or determined by producing a sample of the component from a metallic blank and testing and/or scanning the sample using certain testing and/or scanning techniques capable of measuring total, plastic, and/or elastic strain therein. In various examples, a strain map indicating regions or areas of total, plastic, and/or elastic strain in the component may be generated by modeling techniques and/or testing/scanning techniques.

At 116, the method 100 may include determining a structure of the metallic blank for use in producing the component, including a shape and/or profile of the blank and shapes, sizes/dimensions, and locations of one or more notches along a perimeter of the blank. Each of the individual notches may be configured to distribute, disperse, or otherwise break up a corresponding area of concentrated total strain in the component as determined at 114.

The structure of the blank and the notches thereof may be determined in various manners. In various examples, the shapes, sizes/dimensions, and locations of the notches may be determined using a computational modeling software program configured to model effects of each of the notches on the corresponding areas of concentrated total strain. In various examples, the shapes, sizes/dimensions, and locations of the notches may be determined by producing one or more samples of the component from a metallic blank having test notches formed therein and testing and/or scanning the sample using certain testing and/or scanning techniques capable of measuring plastic strain therein. In various examples, the 2D drawing and/or 3D model of the component previously mentioned, and/or the strain map indicating regions or areas of total, plastic, and/or elastic strain in the component previously mentioned may be used in determining the shapes, sizes/dimensions, and locations of the notches.

As noted, the specific locations, sizes or areas, and concentration of total strain produced in the component will be dependent, for example, on the shapes, sizes, and locations of the features of the structure of the component, materials from which the component is formed, and the parameters of the manufacturing process. Therefore, the quantity, locations, sizes, and shapes of the notches needed to disperse such concentrations of total strain will vary as well, that is, various aspects of the notches are material and application specific.

Furthermore, the notches of the blank may or may not define portions of the component. In some examples, one or more of the notches may located is a waste material region of the blank exterior to a perimeter of the component subsequent to producing the component. In such examples a finishing process may be performed to remove the waste material region. In other examples, at least a portion of one or more of the notches may define a portion of the component. For example, a notch may define a gap in a sidewall of the component. In such examples, the method 100 may include balancing the benefits provided by the notch with the drawbacks of producing the corresponding gap in the sidewall (e.g., reduced structural integrity). In some examples, it may be desirable to provide a minimum quantity of the notches needed to sufficiently reduce the distortions during the manufacturing process.

At 118, the method 100 may include producing the blank having at least one notch along a perimeter thereof that is configured to distribute, disperse, or otherwise break up a corresponding area of concentrated total strain in a component intended to be formed therefrom. In various examples, the blank may be formed from a substantially planar metallic material. Nonlimiting metallic materials for forming the blank include various steels such as, mild, medium, high, and third generation (3rd Gen or Gen3) advanced high-strength (AHSS) steels, and various aluminum alloys. Prior to producing the blank, the metallic material may initially be in the form of, for example, coils or blank sheets.

The blank may be formed from the metallic material by various cutting and shaping techniques. In various embodiments, coils or sheets of the metallic material may be cut into smaller sections to obtain desired initial dimensions for the blanks. Several cutting methods may be employed, such as, but not limited to, shearing, sawing, laser cutting, and/or water jet cutting. Subsequent to the cutting process, a blanking process may be performed to cut the metallic material into a specific geometric shape. In various embodiments, the blanking process may be performed using a mechanical press or a die-cutting machine. The notches of the blank along the perimeter thereof may be formed during the blanking process or subsequent to the blanking process. In some examples, the notches may be formed by a cutting process such as, but not limited to, shearing, sawing, laser cutting, water jet cutting, plasma cutting, and/or computer numerical control (CNC) machining. After all cutting has been completed, edges of the blank may have burrs or sharp edges that may be removed using, for example, various techniques such as grinding, filing, or tumbling. Optionally, the blank may undergo a cleaning processes to remove any contaminants or oils accumulated during the manufacturing process.

At, 120, the method 100 may include producing the component from the blank by, for example, a drawing or stamping process. Such manufacturing processes are known in the art and will not be discussed in detail herein. During and/or upon completion of the component production process, the notches allow or promote relaxation of elastic strain of the component due to the dispersion of the areas of concentrated total strain. This relaxation of the elastic strain may reduce springback and/or oil canning distortion of the component. In various examples, the presence of the notches may reduce distortion from a geometric baseline plane by 50 percent, 60 percent, 70 percent, or 80 percent or more relative to an amount of distortion produced in the component without the presence of the notches.

The method 100 may end at 122.

Figure 2:
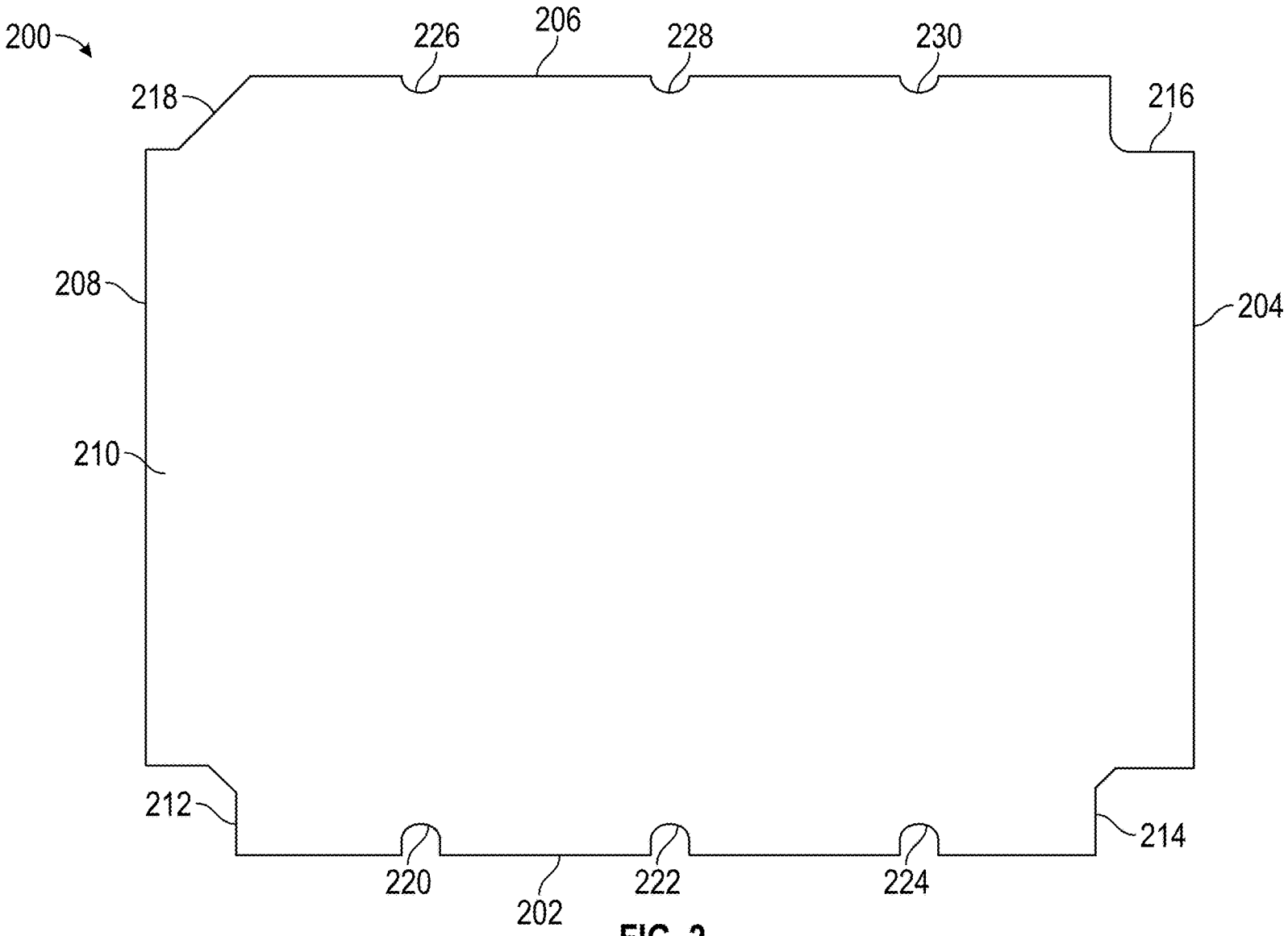
FIG. 2 is a top view of a metallic blank in accordance with various implementations.
Figure 3:
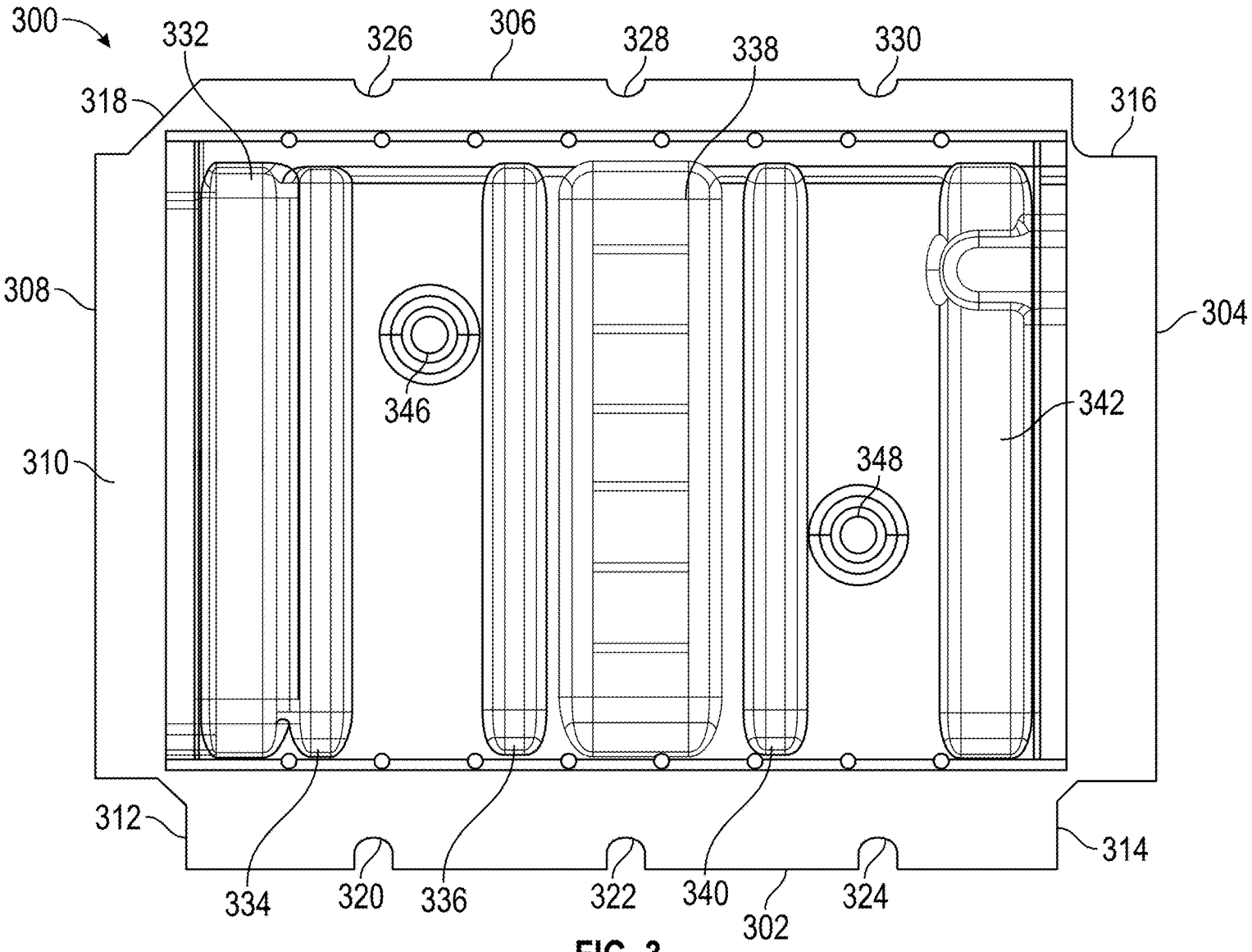
FIG. 3 is a top view of a component produced from the blank of FIG. 2 in accordance with various implementations.

Referring now to FIGS. 2 and 3, and with continued reference to FIG. 1, an exemplary metallic blank 200 and an exemplary component 300 produced therefrom are provided. In this example, the blank 200 and the component 300 are produced in accordance with the method 100 of FIG. 1, including the component 300 being produced from the blank 200 using a drawing or stamping process. The blank 200 and component 300 of FIGS. 2 and 3, respectively, are provided herein as nonlimiting examples to illustrate aspects of the method 100. However, the method 100 is not limited to the specific structures of the blank 200 and component 300 of FIGS. 2 and 3, respectively. In FIGS. 1-3, consistent reference numbers are used to identify the same or functionally related elements, but with a numerical prefix (1, 2, or 3, etc.) added to distinguish the particular example from the other examples.

FIG. 2 is a top view of the blank 200 showing a substantially planar sheet 210 having a generally rectangular profile defined by first, second, third, and fourth side edges 202, 204, 206, 208. The blank 200 includes ten separate notches 212-230 located along a perimeter of the sheet 210. Each of the notches 212-230 are individually configured to distribute, disperse, or otherwise break up a corresponding area of concentrated total strain, which contain areas of elastic strain, in the component 300. Notably, the notches 212-230 have different shapes, sizes, and locations that are based on the structure of the component 300, including locations, sizes, and shapes of certain features thereof, as well as a material of the blank 200, and parameters of the drawing or stamping process used to produce the component 300 from the blank 200.

The blank 200 includes first and second corner notches 212, 214 each defined by first and second straight edges each perpendicular to the adjacent ones of the first, second, and fourth side edges 202, 204, 208 of the sheet 210 and a third straight edge that that connects the first and second straight edges and defines a forty-five degree angle with each of the first and second straight edges. For the first and second corner notches 212, 214, the first and second straight edges have a length measured there along that is greater than a length of the third straight edge. The blank 200 includes a third corner notch 216 defined by first and second straight edges each perpendicular to adjacent ones of the second and third side edges 204, 206 of the sheet 210 that are connected by a third rounded edge. The blank 200 includes a fourth corner notch 218 defined by first and second straight edges each perpendicular to adjacent ones of the third and fourth side edges 206, 208 of the sheet 210 that are connected by a third straight edge that defines a forty-five degree angle with each of the first and second straight edges. For the fourth corner notch 218, the third straight edge has a length measured there along that is greater than a length of the first straight edge and the length of the first straight edge is greater than the second straight edge. The blank 200 includes first, second, and third U-shaped notches 220, 222, 224 along the first side edge 202 of sheet 210 between the first and second corner notches 212, 214 and fourth, fifth, and sixth U-shaped notches 226, 228, 230 along the third side edge 206 of the sheet 210 between the third and fourth corner notches 216, 218. The first, second, and third U-shaped notches 220, 222, 224 have depths greater than depths of the fourth, fifth, and sixth U-shaped notches 226, 228, 230.

Figure 4A:
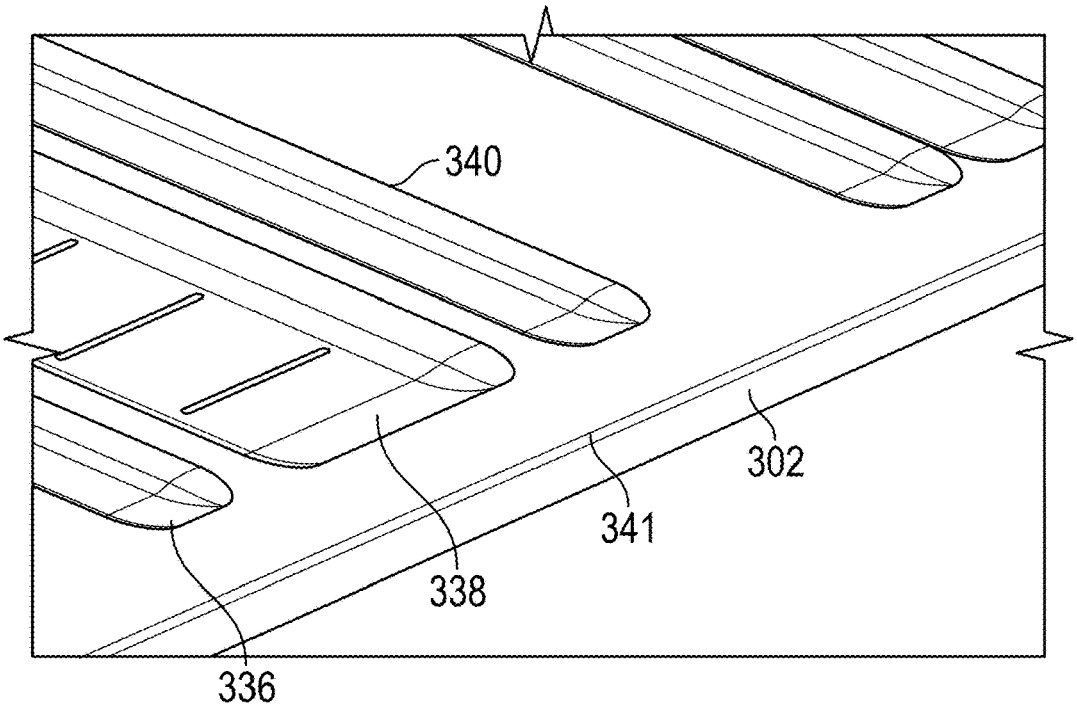
FIGS. 4A, 4B, and 4C include a partial perspective view, a side profile view, and a plan view, respectively, representing a location of a notch for the component of FIG. 3.
Figure 4B:
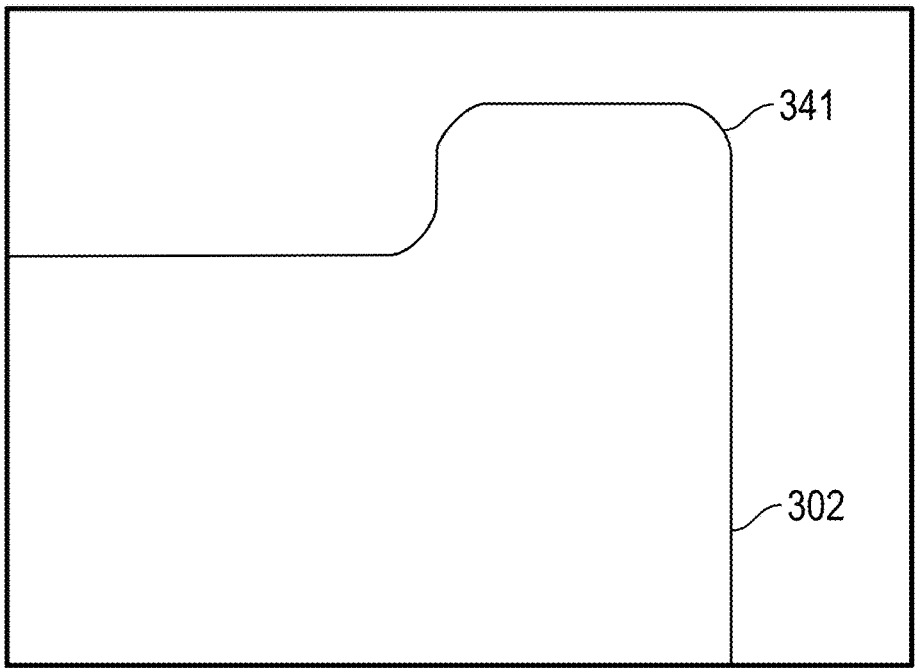
Figure 4C:
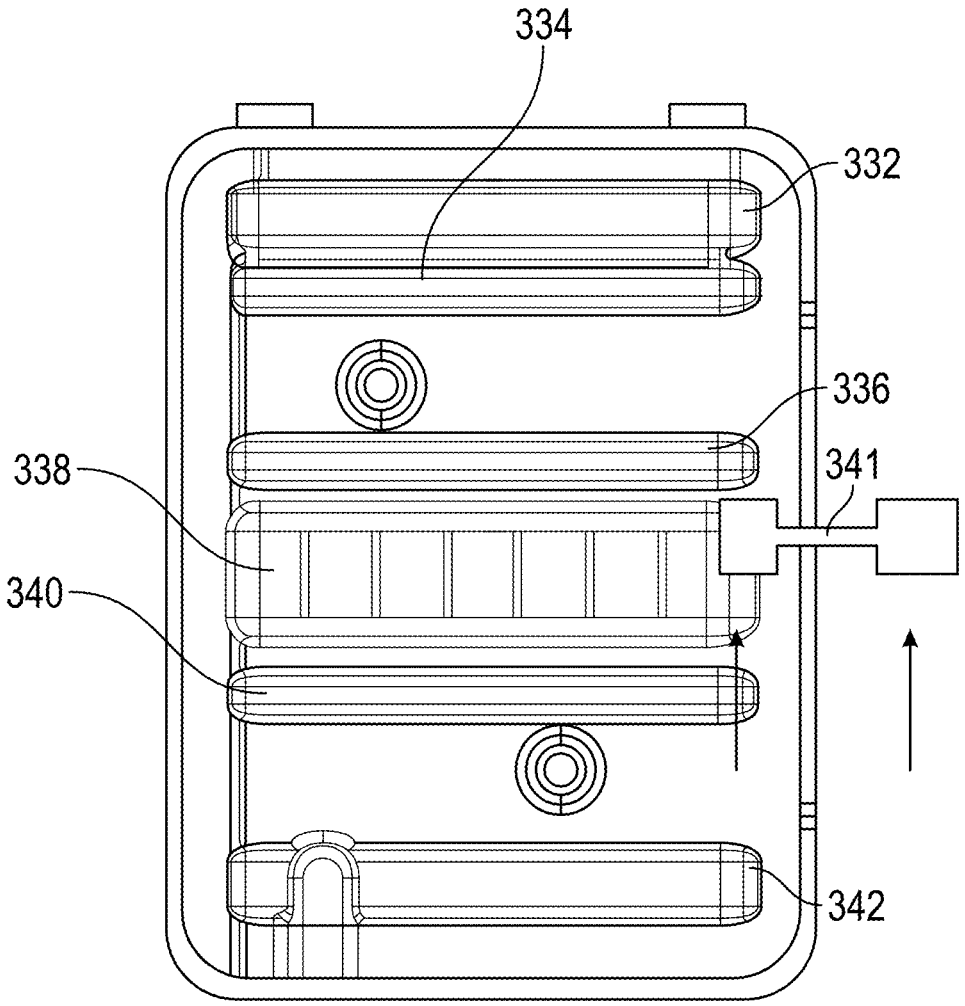

FIG. 3 is a top view of the component 300 subsequent to drawing or stamping the blank 200. As represented, the component 300 includes a panel 310 defined by first, second, third, and fourth side edge 302, 304, 306, 308, and having first, second, third, and fourth corner notches 312-318, and first, second, third, fourth, fifth, and sixth U-shaped notches 320-330. The panel 310 may include various protrusions, recesses, and openings/holes. For example, the panel 310 includes first, second, third, fourth, fifth, and sixth ribs or elongated protrusions 332-342 extending across the panel 310 between the first and third side edges 302, 306, and holes 346, 348. In this example component 300, the notches 312-330 are structured to extend toward a tangency of the "top punch radius" (see FIGS. 4A, 4B, and 4C) to allow for elastic strain in the component 300 to relax in bands having reduced sizes that result in less unstable distortion. In FIGS. 4A-4C, a location 341 of the notch 322 is labeled.

Referring now to FIGS. 5-10, and with continued reference to FIGS. 1-3, modeling predictions and testing measurements of the component 300 of FIG. 3, with and without the notches, are provided that illustrate the effects of the notches on the distortion of components. In FIGS. 5-10, consistent reference numbers are used to identify the same or functionally related elements, but with a numerical prefix (4, 5, 6, or 7, etc.) added to distinguish the particular example from the other examples and from the examples of FIGS. 2 and 3.

Figure 5:
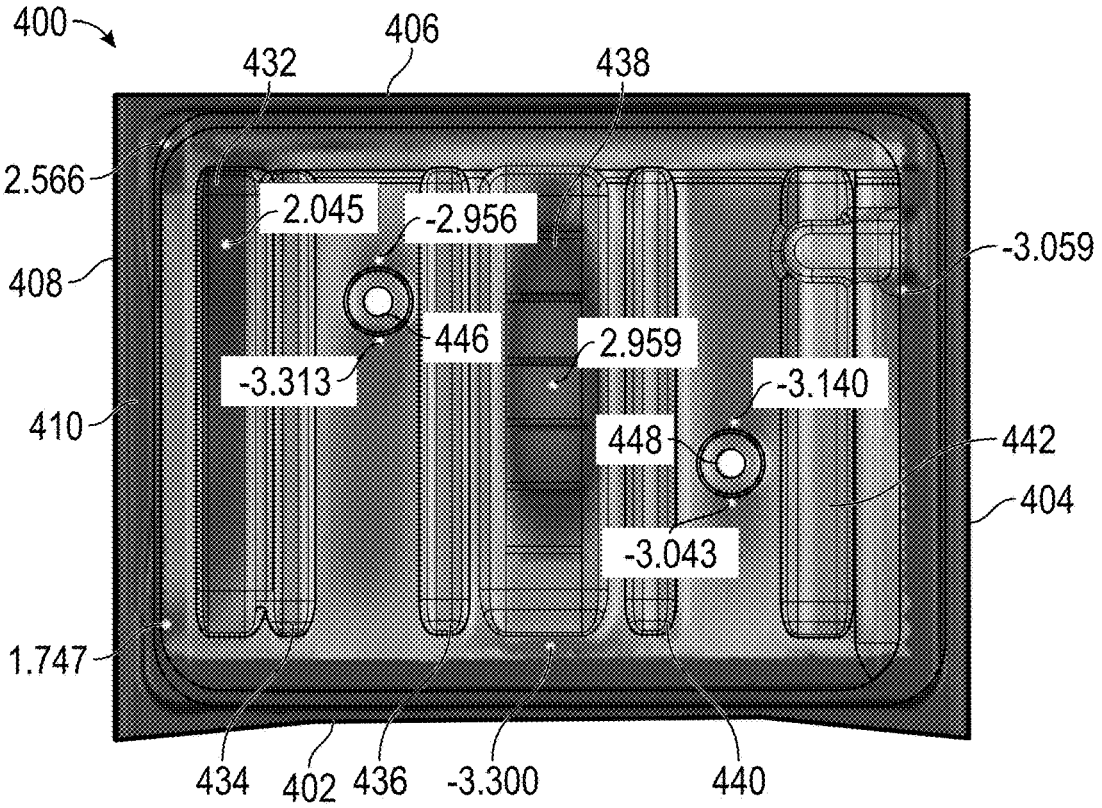
FIGS. 5 and 6 are top views of components having similar structures to the component of FIG. 3 produced from a blank that does not include notches (FIG. 5) and a blank that does includes notches (FIG. 6).
Figure 6:
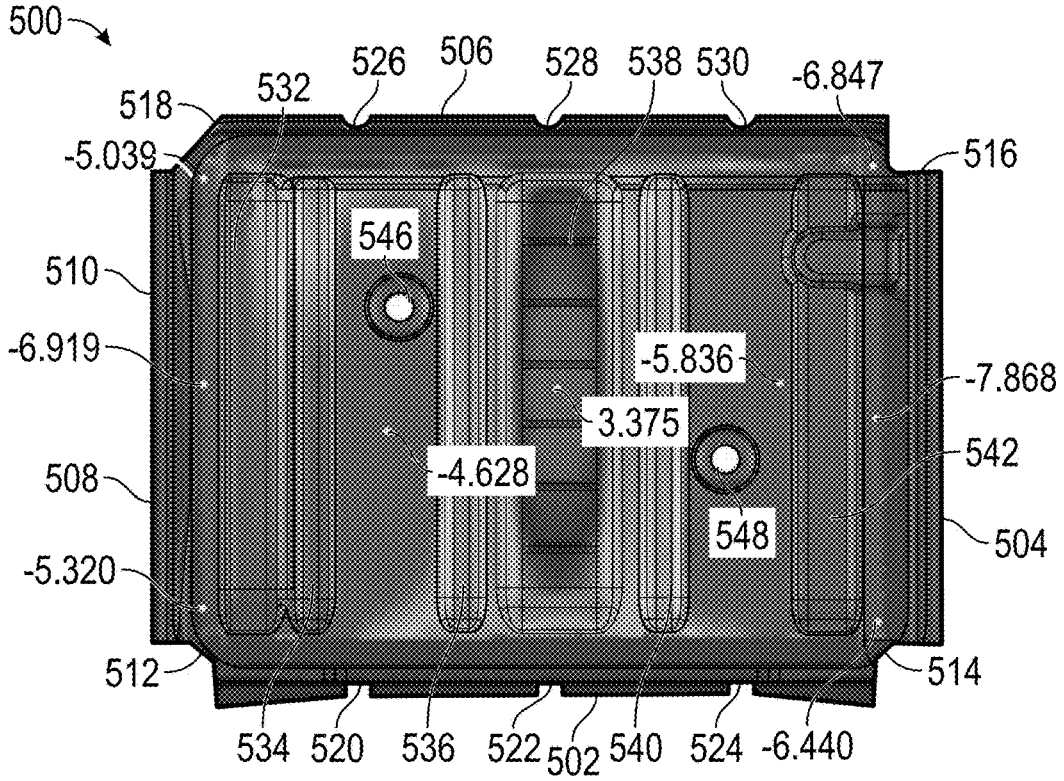

FIGS. 5 and 6 present modeling predictions of distortion in first and second simulated components 400, 500 having similar structures to the component 300 of FIG. 3 and either produced from a blank that does not include notches (FIG. 5) or a blank that does includes notches (FIG. 6). The distortion is represented as predicted measurements in millimeters from a baseline geometric plane corresponding to an initial plane of the blanks from which the first and second simulated components 400, 500 were formed. The predicted measurements are positive or negative to indicate a direction of distortion from the baseline geometric plane. In FIG. 5, the first simulated component 400 was predicted to experience various twisting and wavy bending distortions. In FIG. 6, the second simulated component 500 was predicted to experience a bending distortion about a central region thereof but predicted to experience little to no twisting. While the modeling did not predict that the presence of the notches 512-530 would entirely eliminate distortion in the second simulated component 500, it was predicted that the distortions would have a significantly more controlled behavior with twisting distortions being eliminated or reduced.

Figure 7:
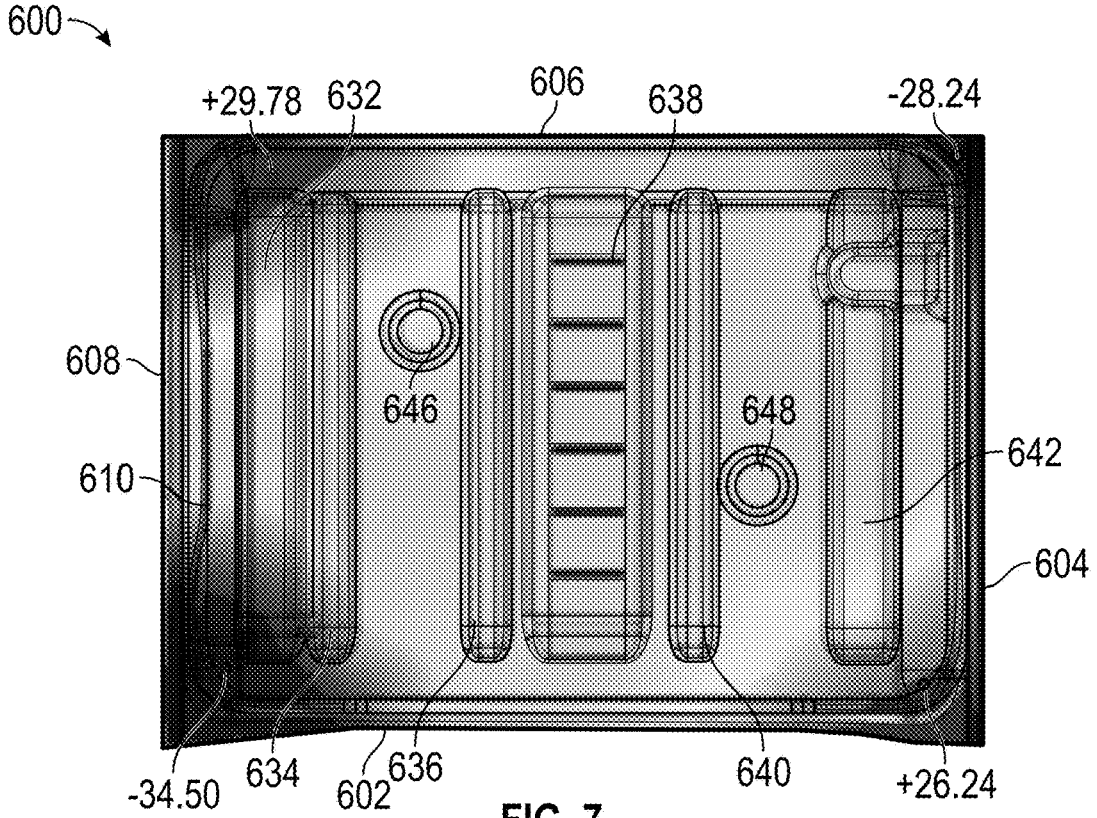
FIGS. 7 and 8 are top views of components having similar structures to the component of FIG. 3 produced from a blank that does not include notches (FIG. 7) and a blank that does includes notches (FIG. 8).
Figure 8:
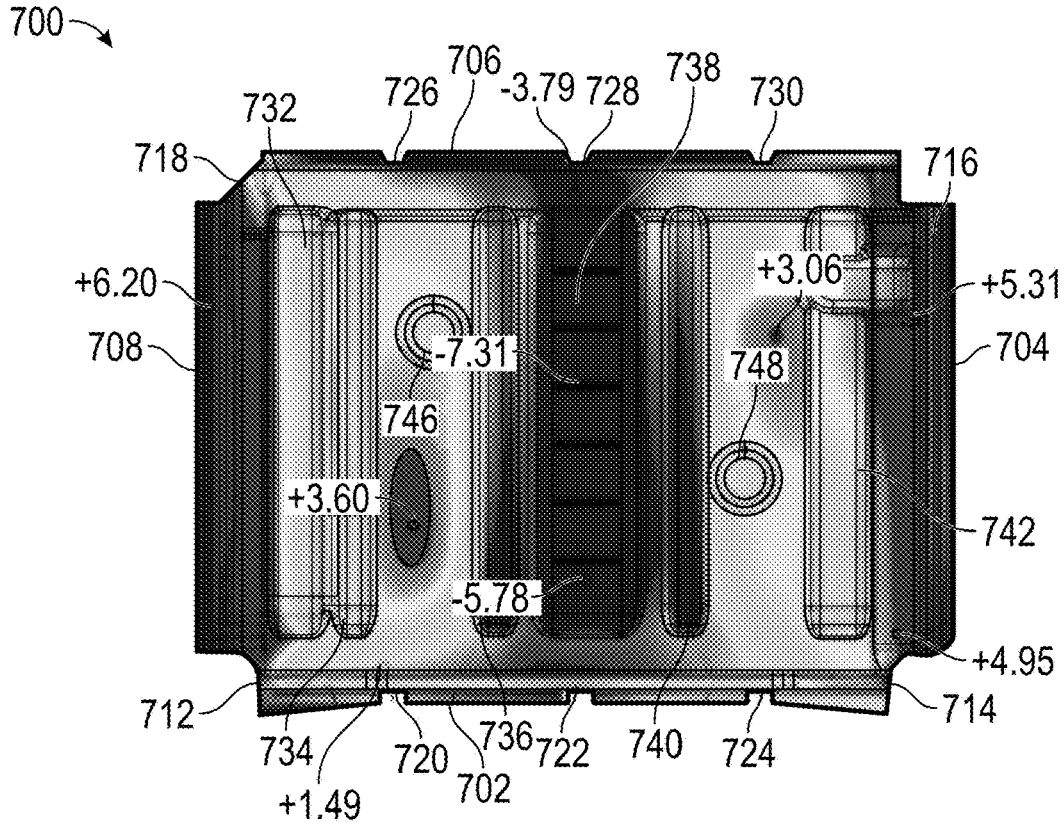

FIGS. 7 and 8 present measurements of first and second sample components 600, 700 obtained with scanning techniques. Similar to FIGS. 5 and 6, the first and second sample components 600, 700 had similar structures to the component 300 of FIG. 3 and were produced either from a blank that does not include notches (FIG. 7) or a blank that does includes notches (FIG. 8). The distortion is represented as measurements in millimeters from a baseline geometric plane corresponding to an initial plane of the blanks from which the first and second sample components 600, 700 were formed. The measurements are positive or negative to indicate a direction of distortion from the baseline geometric plane. In FIG. 7, the first sample component 600 showed severe twisting distortion. In FIG. 8, the second sample component 700 showed relatively minor bending distortion about a central region thereof. These figures indicate that the presence of the notches 712-730 in the blank significantly reduced overall distortions in the second sample component 700, eliminated or reduced twisting distortion, and produced a more controlled distortion behavior.

Figure 9:
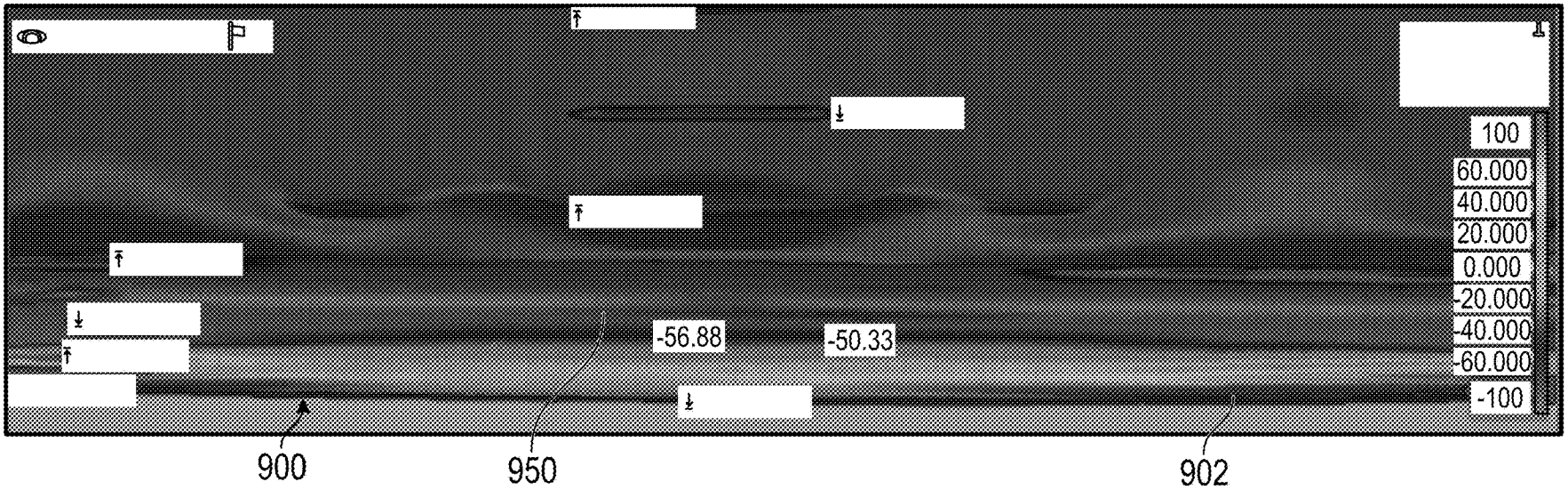
FIGS. 9 and 10 are partial top views of components having similar structures to the component of FIG. 3 produced from a blank that does not include notches (FIG. 9) and a blank that does includes notches (FIG. 10).
Figure 10:
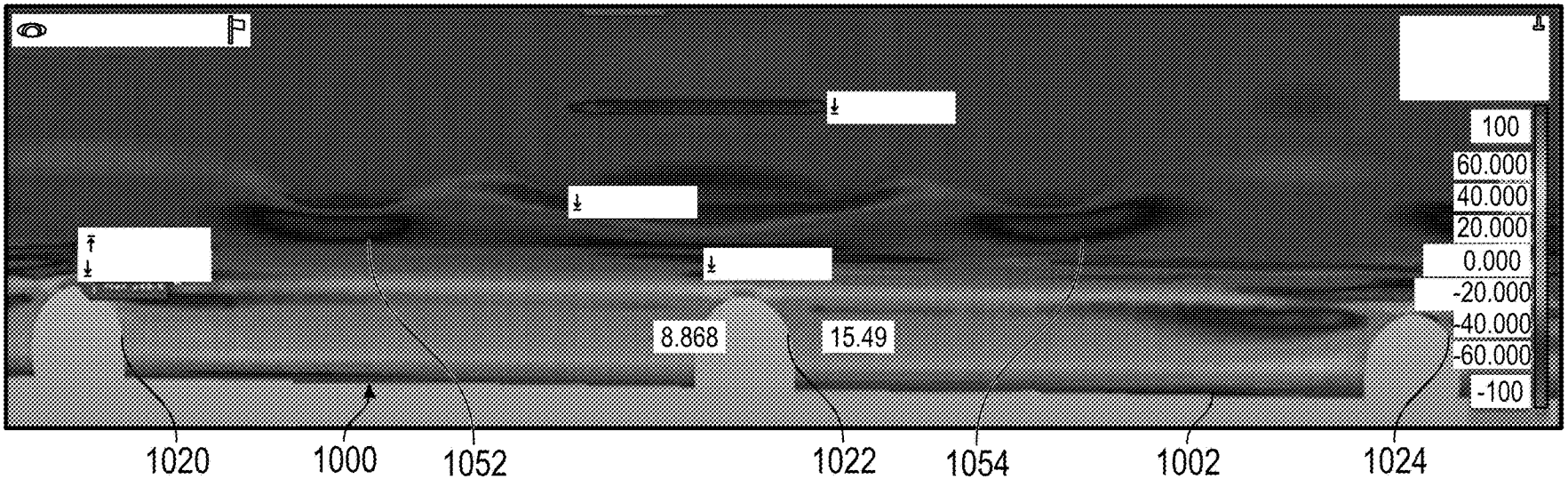

FIGS. 9 and 10 present modeling prediction of in-plane stress in third and fourth simulated components 900, 1000 having the similar structures to the component 300 of FIG. 3 and either produced from a blank that does not include notches (FIG. 9) or a blank that does includes notches (FIG. 10). The stress is represented as predicted measurements in Newtons per millimeter (N/mm) in the t direction (left to right) due to retained elastic strain when the components 900 and 1000 are in a free state of relaxation without gravity after a draw stage of the manufacturing process. In FIG. 9, the third simulated component 900 was predicted to include an area of concentrated total strain that included a region of retained elastic strain 950 causing compressive forces (i.e., attempting to constrict or shrink) but which was restricted due to plastic deformation surrounding the region. This region of retained elastic strain 950 would be expected to result in various twisting and wavy bending distortions. In FIG. 10, the fourth simulated component 1000 was predicted to include smaller areas of total strain due to the notches. In particular, it was predicted that the notches split up the areas of plastic strain and thereby allowed the elastic strain to relax resulting in much smaller regions of elastic strain (e.g., regions of elastic strain 1052 and 1054). As such, the fourth simulated component 1000 was in a lower energy state with reduced constrictive forces, and therefore would be expected to result in limited dimensional change and little to no twisting.

The methods, blanks, and components disclosed herein provide various benefits over certain existing methods, blanks, and components. For example, production of certain components from blanks cause compressive stresses to remain trapped therein resulting in springback distortion of the components. The methods and blanks provided herein are capable of mitigating this distortion by providing notches configured to distribute, disperse, or otherwise break up a corresponding area of concentrated plastic strain in the component and thereby reduce the likelihood of springback distortion. As such, the methods, blanks, and components disclosed herein provide effectuate an improvement in the technical field of manufacturing components from metallic blanks.

Figure 11:
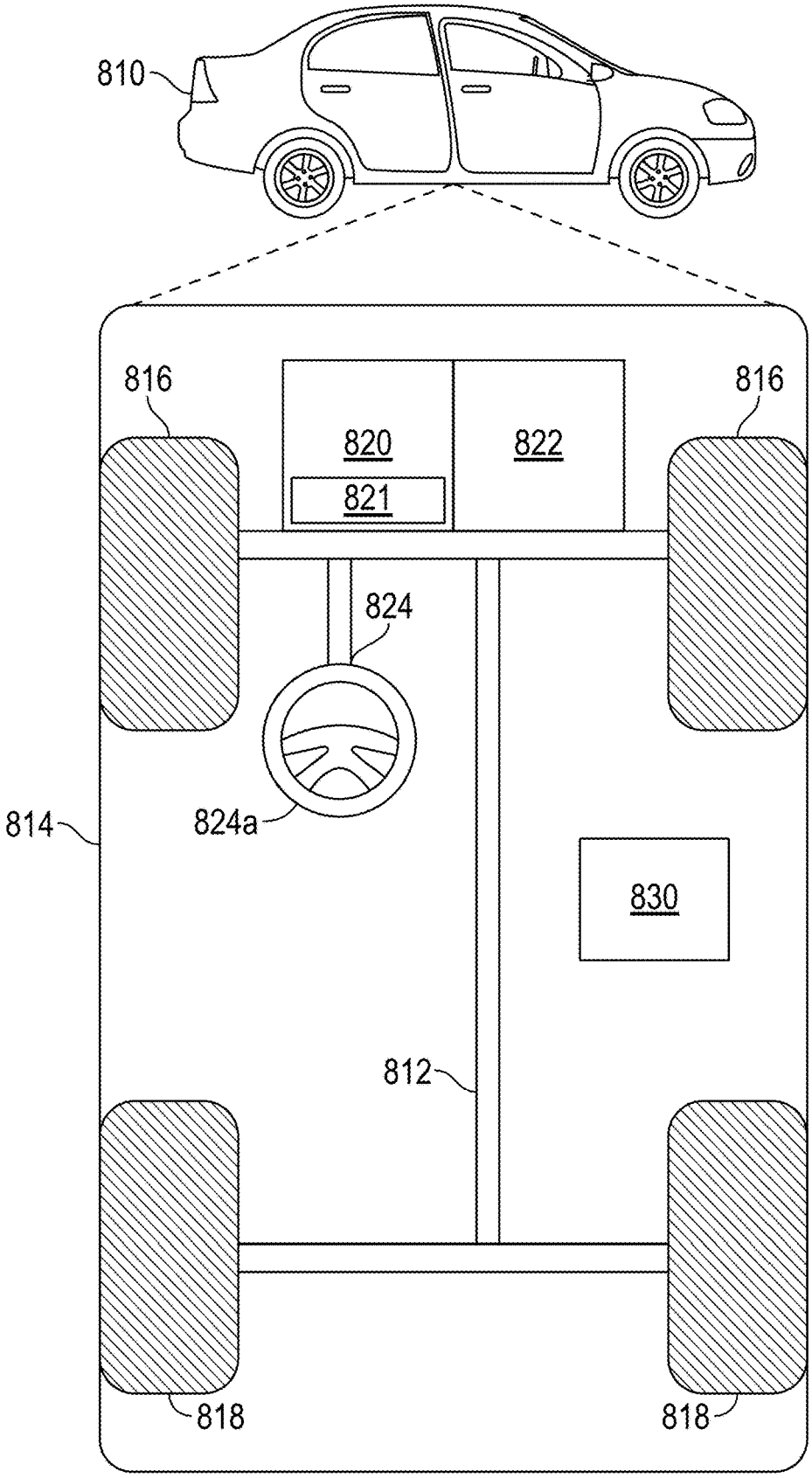
FIG. 11 is a functional block diagram illustrating a vehicle in accordance with various implementations.

The methods and blanks provided herein may be used to produce various components. In some examples, the components are structural components of a vehicle. As a non-limiting example, FIG. 11 illustrates a vehicle 810, according to an exemplary implementation. In certain examples, the vehicle 810 comprises an automobile. In various examples, the vehicle 810 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD), and/or various other types of vehicles, such as various commercial or recreational vehicles on land, water and in the air, in certain embodiments. In addition, in various examples, it will also be appreciated that the vehicle 810 may comprise any number of other types of mobile platforms.

As depicted in FIG. 11, the exemplary vehicle 810 generally includes a chassis 812, a body 814, front wheels 816, and rear wheels 818. The body 814 is arranged on the chassis 812 and substantially encloses components of the vehicle 810. The body 814 and the chassis 812 may jointly form a frame. The wheels 816-818 are each rotationally coupled to the chassis 812 near a respective corner of the body 814.

The vehicle 810 further includes a propulsion system 820, a transmission system 822, a steering system 824, and at least one structural component 830. The propulsion system 820 may, in various implementations, include an internal combustion engine, an electric machine such as a traction motor, and/or a fuel cell propulsion system. The transmission system 822 is configured to transmit power from the propulsion system 820 to the wheels 816, 818 according to selectable speed ratios. According to various embodiments, the transmission system 822 may include a step-ratio automatic transmission, a continuously-variable transmission, or other appropriate transmission. The brake system 826 is configured to provide braking torque to the vehicle wheels 816, 818. The steering system 824 influences a position of the wheels 816-818. While depicted as including a steering wheel for illustrative purposes, in some embodiments contemplated within the scope of the present disclosure, the steering system 824 may not include the steering wheel 824*a*.

The structural component 830 may have various shapes, sizes, structures, and intended functions. Nonlimiting examples may include floor panels, battery covers/trays, etc. The structural component 830 may include a plurality of protrusions, recesses, holes, and the like. The structural component 830 may be produced using the method 100, and certain aspects of the structural component 830 may be derived from the manufacturing process by which the structural component 830 is produced.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A method, comprising:

determining a location of an area of concentrated total strain based on a structure of a component to be produced prior to forming the component, the component including elongated protrusions, wherein the area of concentrated total strain includes elastic strain trapped by plastic strain caused by the elongated protrusions, wherein the trapped elastic strain is sufficient to cause springback and/or unstable physical distortion of the component subsequent to production thereof upon release of forces applied during a drawing or stamping process;

forming at least one notch along a perimeter of a metallic blank that is configured to be used to produce the component based at least in part on the location of the area of concentrated total strain, wherein the at least one notch is configured to reduce the elastic strain trapped in the component during and/or subsequent to the drawing or stamping process; and producing the component from the metallic blank by the drawing or stamping process, wherein the at least one notch provides for relaxation of the elastic strain trapped within the component during the drawing or stamping process and thereby reduces distortion of the component subsequent to completion of the drawing or stamping process upon release of the forces applied during the drawing or stamping process.

2. The method of claim 1, wherein the at least one notch is formed in the metallic blank prior to producing the component therefrom.

3. The method of claim 2, further comprising:

generating a strain map for the component, wherein determining the location of the area of concentrated total strain is performed, at least in part, using the strain map; and determining a size, shape, and location of the at least one notch, at least in part, using computational modeling.

4. The method of claim 1, further comprising forming the at least one notch at a corner of the metallic blank.

5. The method of claim 1, further comprising forming the at least one notch along a side edge of the metallic blank between a pair of corners thereof.

6. The method of claim 1, further comprising forming the at least one notch to define a gap in a sidewall of the component.

7. The method of claim 1, wherein the metallic blank is formed of a mild, medium, high strength, or third generation (3rd Gen or Gen3) advanced high-strength (AHSS) steels, or an aluminum alloy.

8. The method of claim 1, wherein the component is configured to be installed as a structural component of a vehicle.

* * * * *